United States Patent [19]

Lane et al.

[11] 4,393,611

[45] Jul. 19, 1983

[54] PERPETUAL CALENDAR

[75] Inventors: Ronald S. Lane, 406 Deer Creek Dr., Plainsboro, N.J. 08536; James M. Wittes, Linden, N.J.

[73] Assignee: Ronald S. Lane, Plainsboro, N.J.

[21] Appl. No.: 271,613

[22] Filed: Jun. 8, 1981

Related U.S. Application Data

[63] Continuation-in-part of Ser. No. 10,336, Feb. 8, 1979, Pat. No. 4,275,516, which is a continuation-in-part of Ser. No. 798,273, May 19, 1977, Pat. No. 4,142,311.

[51] Int. Cl.[3] ..... G09F 3/00

[52] U.S. Cl. ..... 40/107; 40/497; 40/111

[58] Field of Search ..... 40/107, 109, 119, 111, 40/497; 434/189, 347

[56] References Cited

U.S. PATENT DOCUMENTS

| | | | |
|---|---|---|---|
| 247,000 | 9/1881 | Bath | 40/107 |
| 301,553 | 7/1884 | Bereman | 40/109 |
| 1,109,814 | 9/1914 | Bailey | 40/107 |
| 2,401,162 | 5/1946 | Kaufman | 40/111 |
| 4,137,659 | 2/1979 | Eddy | 40/107 |
| 4,142,311 | 3/1979 | Lane | 40/107 |
| 4,275,516 | 6/1981 | Lane | 40/107 |

*Primary Examiner*—Mickey Yu
*Attorney, Agent, or Firm*—Darby & Darby

[57] ABSTRACT

An improved permanent calendar assembly is disclosed which is to display any month of any year. The construction includes a flat main body with forwardly protruding tracks for removable mating with date columns. For flexibility of display, end pieces carrying one of the dates "29", "30" and "31" on one surface and a blank on an opposed surface are rotatably or pivotally mounted at the bottom of the date columns so that either side of any of the end pieces may be selected for display. The calendar also features a construction that allows easy removal and rearrangement of the vertical date columns and yet prevents their disengagement when, for example, when the calender is tilted forward. At least one lipped horizontal track extends across the rear of the date column area. Defined in the back wall of each date column are at least two openings or grooves that can mate with the track, as desired. The lip results in a track with surfaces facing in more than one direction and particularly with an engaging surface which has a surface that mates with an opposed surface in each date column groove when the calendar is tipped forward to prevent the date column from falling.

10 Claims, 12 Drawing Figures

PERPETUAL CALENDAR

This is a continuation-in-part of U.S. patent application Ser. No. 10,336, filed Feb. 8, 1979, now U.S. Pat. No. 4,275,516, which was a continuation-in-part of U.S. patent application Ser. No. 798,273, filed May 19, 1977, now U.S. Pat. No. 4,142,311.

This invention relates primarily to constructions for calendar displays and, more particularly, to constructions for displays adaptable to show the dates in any month of any year.

Permanent calender displays are known in the art which comprise a series of columns attached to a substantially flat main body. A basic problem contended with in such calendars is providing a display which is conveniently adapted for months that are "28", "29", "30", and "31" days long. Most months it is necessary to re-position the vertical date columns, and to adjust certain of them to account for the length of the month.

In U.S. Pat. No. 4,142,311, there are disclosed a number of arrangements for coping with the "month length" problem by providing endpieces at the bottom of selected date columns which are rotatably reversible to indicate various month lengths. These arrangements have provided a particularly effective solution to the "month length" problem. However, a construction was needed which would be more amenable to modern mass production techniques and particularly to being made from a plastic material by conventional processes.

Accordingly, a primary object of the present invention is to provide an improved permanent calendar construction.

Another object of the present invention is to provide a calendar structure which solves the month-length problem by permitting adjustment of the last date in selected date columns.

Still another object of the present invention is to provide vertical date columns indicating variable length months which may easily be removed from and replaced on the main calendar body member.

A further object of the present invention is to provide a permanent desk calendar which is simple in construction, yet attractive and convenient in use.

Still a further object of the present invention is to provide a device of the character described which may be manufactured from various plastic materials by conventional processes and is highly durable in use.

Still another object of the present invention is to provide a construction of the character described which is simple and inexpensive to manufacture, yet durable and simple to operate.

These and other objects of the present invention are accomplished in preferred and alternative embodiments of the present invention which feature a generally flat main body member with forwardly protruding tracks upon which are positioned seven date columns. The "month-length" problem is dealt with by providing a rotatable or pivotally mounted, reversible portion at the bottom of at least one of the date columns. Preferably, the reversible portion is in the form of a block which has a numeral on one side and is blank on the opposite side. The block may then be positioned to display either its numeral or the blank. Preferably, the three columns including the numerals "29", "30" and "31" are provided with such rotatable portions so that the display can be adjusted to display any number of days, from 28 to 31, by appropriately manipulating the reversible portions.

Other objects, features and advantages of the present invention will become apparent by reference to the following more detailed description of presently preferred, yet illustrative embodiments of the present invention and reference to the accompanying drawings, wherein:

FIG. 1 is a front perspective, partially exploded view showing one of the vertical date columns in exploded position off the track, and showing one of the month display members off the track, and showing one of the month display members in exploded position above the month receptacle;

FIG. 2 is an enlarged cross-sectional view of FIG. 1 taken along the line 2—2 of FIG. 1, the end piece being illustratively represented as one embodiment disclosed in U.S. Pat. No. 4,142,311;

Figure 1:
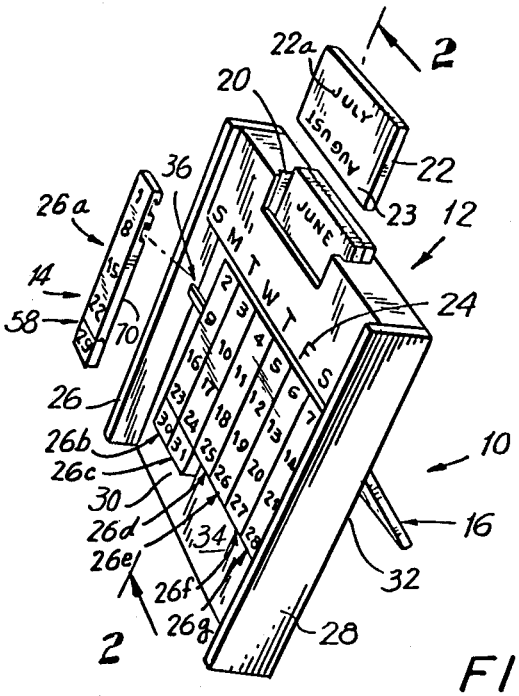

Turning in detail to the drawings, and more particularly to FIG. 1, there is shown a permanent calendar 10 comprised broadly of a main body member 12, vertical date columns 14, and a support stand 16.

More specifically, the main body member 12 includes an upper portion 18 containing a month receptacle 20, in order to retain a plurality of month display members 22. Each of the month display members displays indicia **22*a* of two months on each of its sides 23. The said two months are arranged in an upside-down relationship so that only one legible month at a time is displayed through display window of receptacle 20. These units may be rearranged in the well known fashion to display the appropriate month. The upper portion 18 also includes a weekday indicia 24** which permanently sets forth the columns for the particular day of the week for the month in question.

Depending downwardly from the upper position 18 is a left side wall 26 and a right side wall 28 defining the date column area of well 30 all within the lower portion 32. The well is bounded in the rear by the man body front wall 34.

Protruding into the date column area 30 are date column tracks 36 onto which are selectively and removable mounted date columns 26*a*, 26*b*, 26*c*, 26*d*, 26*e*, 26*f*, 26*g*. Each date column displays four date indicia, each separated in numerical value from the preceding and succeeding displayed date on that date column by seven. Thge date columns each have two rearwardly open track openings 72, so that at least two positions of height of attachment are within the mating capability of each date column.

Positioned on the front wall 34 and towards the upper portion 18 is the lipped track 36 as shown in the preferred embodiment. Alternatively, as shown in FIG. 19, the tracks may consist of two uni-directional tracks 36' with three mating open track openings 72'. The track consists of a horizontal portion also has a major horizontal axis 43 which is perpendicular to the major axis on the front wall. Extending upwardly from the horizontal portion 38 is a vertical portion 44 which is parallel to and spaced from the front wall and is perpendicular to the horizontal portion. The vertical portion is defined by an inner surface 46, an outer surface 48, and a top surface 50. The portion also has a vertical axis 51 which is perpendicular to the horizontal axis 43 of the horizontal portion 38.

The main body member 12 is bounded on the reverse side by a rear wall 52 having an opening 54 for a hainging hook. The rear wall also has defined therein a cutout portion 56 for the purpose hereinafter appearing.

Figure 2:
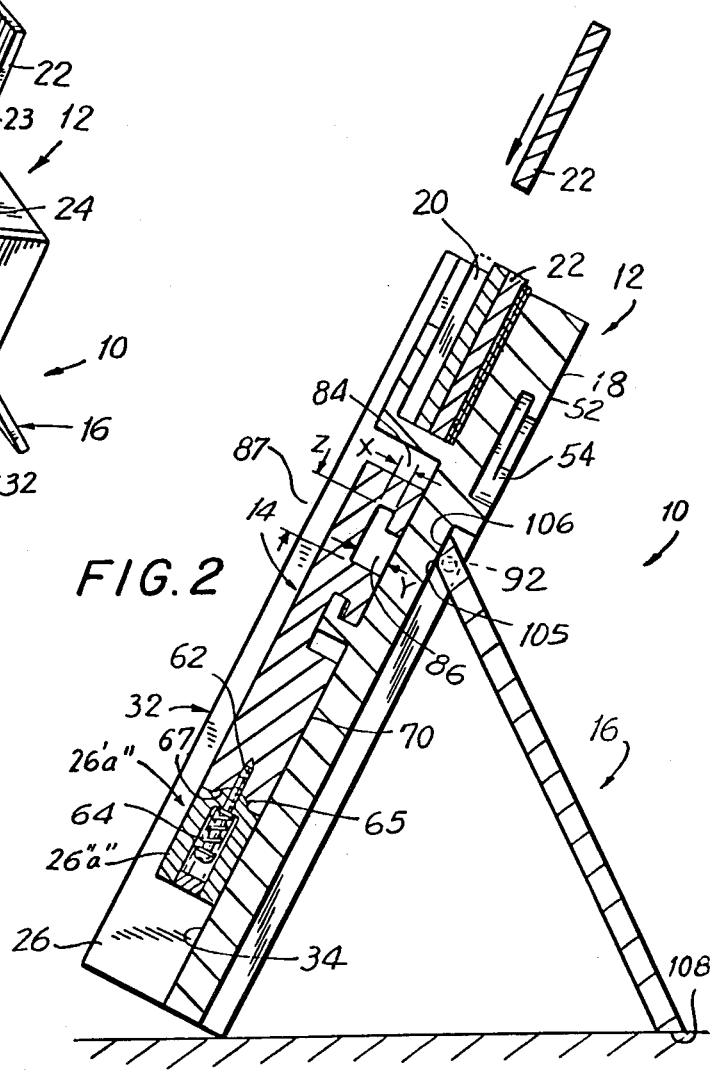
Figure 3:
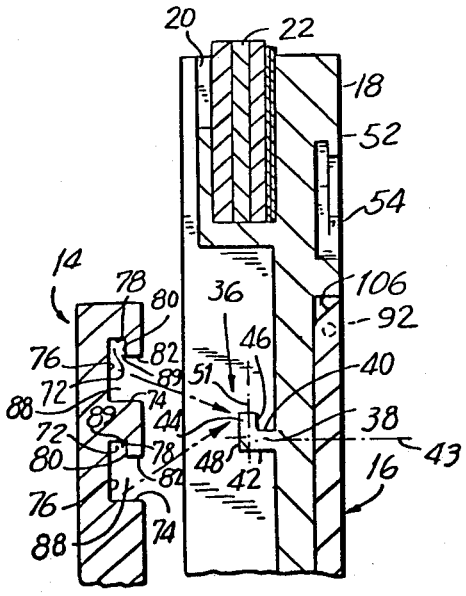
FIG. 3 is an enlarged partially cut-away sectional view, similar to FIG. 2, and showing the vertical date column exploded from the track and showing the ability of either the grooves to be received on the track.
Figure 4:
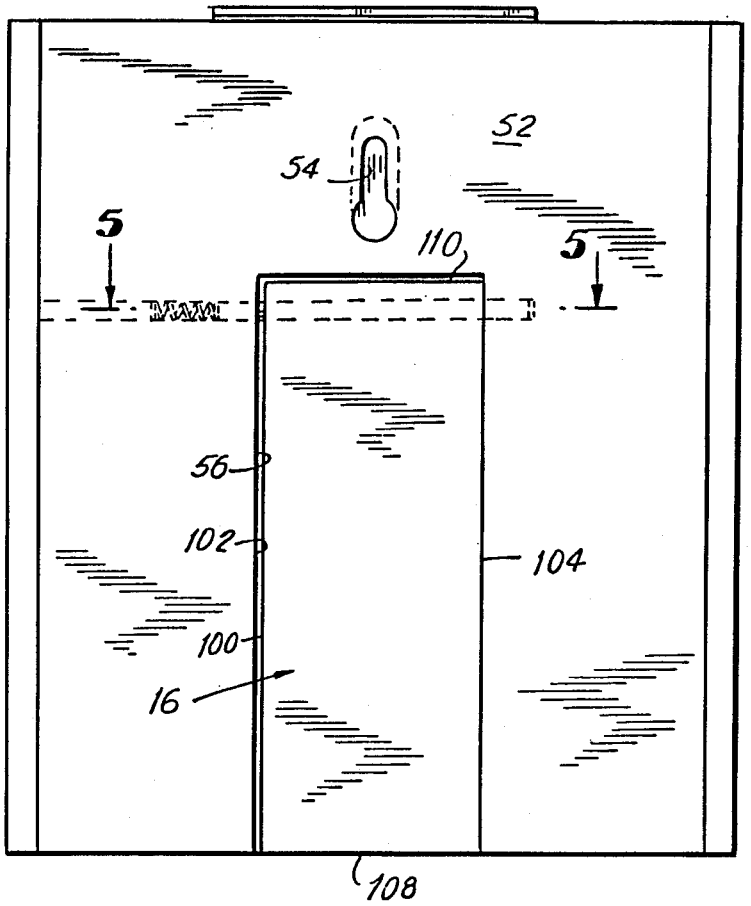
FIG. 4 is a rear elevation view of the main body member and with the stand in the retracted position.
Figure 5:
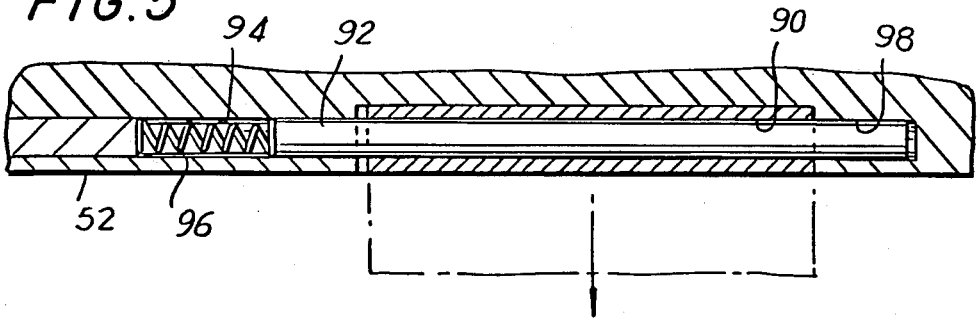
FIG. 5 is an enlarged partially cut-away sectional view taken along the line 5—5 of FIG. 4, and showing the stand in dotted line and in its extended position.

The structure shown in FIGS. 1 and 2 for the date columns 14 and the securement means will be described as having a rotatable mounting structure 26'*a*" including an end piece 26"*a*" retained to the main column 14 by means of a screw 62 and a compression spring 64. The particular embodiment shown includes a ridge 66 defined in the date column. Of course, any type of means may be utilized to retain either permanently or detachably, an end piece to the vertical date column.

Defined in the rear wall 70 of each date column 14 are at least two track receiving openings or grooves 72. The openings are defined by a horizontal base surface 74, extending inwardly from the outer wall. Then, extending upwardly is a vertical surface 76 terminating at an upper horizontal surface 78 parallel to the horizontal surface 74. The surface extends outward towards the rear wall for a short distance and then there is depending therefrom a parallel opposed short vertical surface 80 and then another parallel opposed short horizontal upper surface 82. This surface is parallel to the surfaces 78, 74 and extends outwardly to the rear wall 70. The surfaces 74, lower part of 76 and 82 form a slot 88 and the surfaces including the upper part of 76, 78, 80 form a channel 89.

The width between the parallel vertical surfaces 76, 80 is defined as X and is identified by the numeral 84. In a similar manner, the distance between the parallel opposed vertical surface 80 and the rear wall 70 is defined by the width "Y" and identified by the reference numeral 86. Furthermore, the distance between the parallel opposed horizontal surfaces 74, 82 is defined by the width "Z" and identified by the reference numeral 87.

Figure 6:
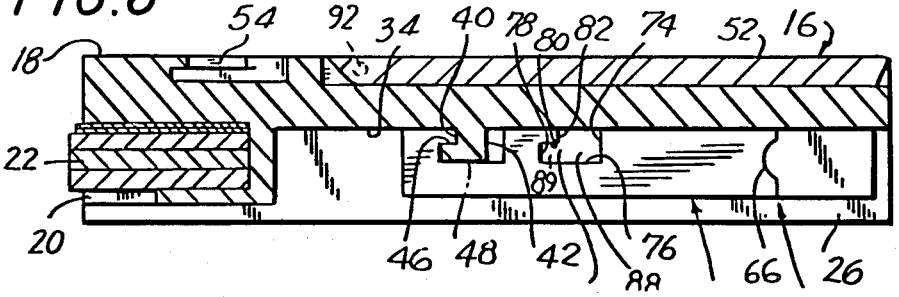
FIG. 6 is a cross-sectional view similar to FIG. 2 with the stand in retracted position, and showing the main body member in a tilted forward parallel position to the ground, with the vertical column illustrated being retained in operative position by the track.

One of the main features of the calendar resides in the construction of the track and the receiving groove. The track is designed in the preferred embodiment illustrated, to form a right angle. The width X is sufficient to receive the vertical portion in a snug but not overly tight fit. In the same fashion the width Y is sufficient to correspond to the length of the upper surface 40 of the horizontal portion 38 of the track. When it is desired to place the date column on the track or remove it, the appropriate groove is selected and the track is received within the groove. The angle is sufficient to retain the track at all times, including in the position shown in FIG. 6 where the main body member 12 is in a forward horizontal position to the ground.

It is understood that several design considerations must be reviewed in order that this construction work properly. Among these considerations are the fact that the track in its preferred embodiment may be lipped, but it can ba a single straight or curved element, as long as the end portion furthest from the back wall terminates at an angular direction which is upwardly from the perpendicular axis 43. Furthermore, this angle in the upward direction, can be no less that 90 degrees for obvious reasons. The more practical constructions will consist of a two element unit as shown, or it may consist of an inverted wedged shaped element substantially forming a trapezoid with the back wall, or it may consist of a horizontal element, and then a wedged shaped element with the inner surface extending diagonally upwardly. Another possible construction would be a curved chordal member resembling a portion of a washer. Any of these constructions are adequate as long as the vertical date column may be easily retained securely to said main body member, but may be easily removed, when so desired. Futhermore, the date members may easily be slid horizontally along the track.

It has been found that the orientation of the engaging faces accounts for the date columns being retained against falling when the calendar is tilted forward. Specifically, at least a portion of the engaging surface on the track does not face upward (i.e. it is either parallel to front wall 34 or faces at least partially downward). This result is not achieved in the prior art, where the track includes no such engaging surface. This is assured if that portion is constructed so that lines normal to the surface at that point and directed away from the surface have no upwardly directed component.

It will be appreciated that a similar result is achieved if the track extends rearwardly from the date column and has a downward lip and the groove is in the main body, as long as the engaging surfaces have this above defined relationship.

With the described embodiment, date columns may be removed or rearranged simply by placing a finger at the bottom of the end piece and pushing upwardly until the column drops out. At the same time, the construction prevents the columns from falling or becoming detached, as previously mentioned, which otherwise occurs quite often when the calendar is being changed or when it is being examined for possible purchase.

Owing to the ease and simplicity with which the columns may be removed, a minimum of columns have to be repositioned at any one time in order to set up the calendar for a new month, the rest of the columns sliding to the left or to the right along the track.

One arrangement utilized in U.S. Pat. No. 4,142,311 for adjusting for month length is illustrated in FIG. 2 where there is shown a date column 26"*a*" normally ending in the numeral 22, 23 or 24 and to which is secured a rotatable mounting structure or end piece 29. The mounting structure consists of a basically rectangular piece 26"*a*" which is essentially of the same cross-sectional dimensions as the column 26"a". Protruding above the structure is a ridge 65 running the entire length of the structure which ridge mates with a groove 67 having a conforming shape and size. A screw 62 on which is concentrically mounted a spring 64 extends upwardly through a hole in structure 29 and is secured into the bottom of the date column. In operation the screw 62 is adjusted so that spring 64 exerts a sufficient force between the head of screw 62 and structure 29 to maintain the ridge 65 in contact with groove 67, while permitting free rotation of structure 29 with respect to screw 62 and the date column to achieve month length adjustment. Such rotation is achieved by pulling end piece 29 downward against spring 64 to withdraw ridge 65 from groove 67 while twisting the end piece.

Although the structure 29 provided a useful solution to the month length problem, it proved commercially feasible only for relatively expensive calendar displays made, for example, of wood. A preferred calendar construction for mass production would have date columns (and probably the entire calendar) molded from a plastic material. The structure 29 then becomes too complex for simple mass production and could require time consuming hand assembly. Alternate structures for solving the month length problem were therefore sought.

Figure 7:
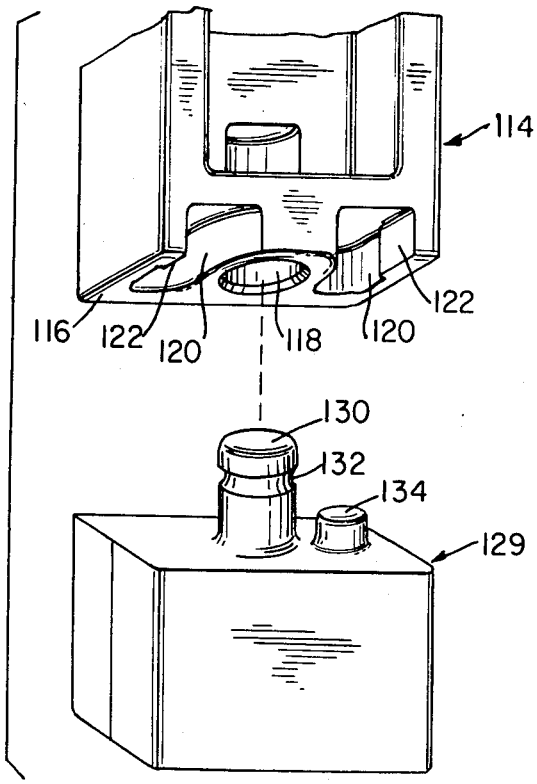
FIG. 7 is an exploded, fragmentary perspective view of the lower portion of a date column incorporating a rotatable endpiece for adjusting for month length, the column being viewed from the rear.
Figure 8:
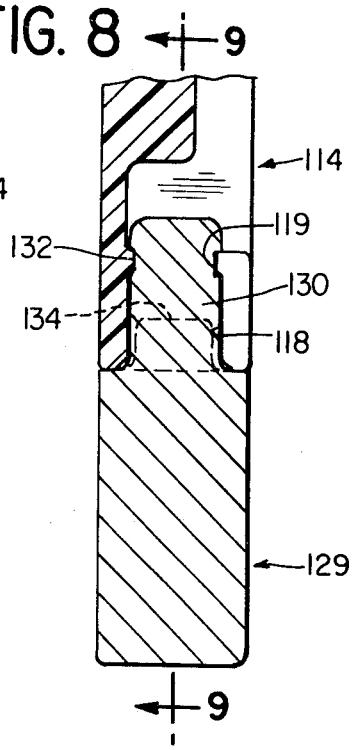
FIG. 8 is a sectional view through the center of the column of FIG. 7 taken from the left side.
Figure 9:
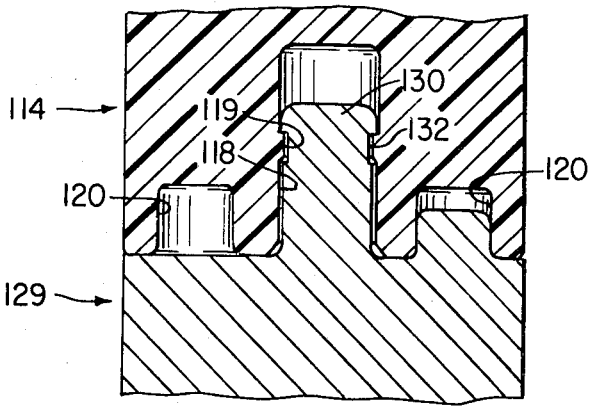
FIG. 9 is a sectional view taken along line 9—9 in FIG. 8.

FIGS. 7–9 illustrate one presently preferred structure for solving the month length problems. There is shown a date column 114 which may be substituted for any of these three longer date columns 26*a*, 26*b* and 26*c* in FIG. 1. Secured at the bottom of the date column 114 is a rotatable end piece 129. In FIG. 7, date column 114 and end piece 129 are viewed from the rear, so that the date indicia are not visible. As will be appreciated from the preceding description, however, date column 114 will bear the indicia of one of column 26*a*, 26*b* or 26*c* on its front face, and end piece 129 will bear the indicium 29, 30 or 31 on one face and will be blank on its other face. This construction will permit rotation of end piece 129 to adjust for month length.

Date column 114 could be made of a plastic material, for example, by molding. It is essentially a hollow, rectangular block. Column 114 includes a bottom wall 116, provided with an upwardly extending, countersunk bore 118 which, at it innermost extreme, has a portion 119 of reduced diameter defining an inwardly directed flange. In addition, column 114 includes the cutouts 120, 120 in bottom wall 116 which extend through the rear of column 114. Each cutout 120 includes an inwardly directed protrusion 122 at its rear.

End piece 129 includes an upwardly projecting shaft 130 having a circumferential groove 132. Shaft 130 is dimensioned to be journaled within bore 118 of column 114 and groove 132 is positioned and dimensioned to receive the flange portion 119 of bore 118 when shaft 130 is mounted inside the bore (see FIGS. 8 and 9). To one side of the shaft 130, end piece 129 includes an upwardly projecting lug 134 positioned to be received in the passageways 120, 120 when end piece 129 is mounted to column 114 and properly rotated. Lug 134 is positioned to interfere slightly with the protrusions 122 when end piece 129 is rotated to bring the lug into one of the cutouts 120, but to fit freely in the inner portions of the cutouts.

Owing to the construction of column 114 and end piece 129, these two elements can be assembled readily. It is only necessary to insert shaft 130 into bore 118 and press end piece 129 upward until flange portion 119 enters groove 132. Column 114 is preferably made of a resilient material (plastic) so that flange 119 is deformed when shaft 130 is inserted into bore 118. When flange 119 is aligned with groove 132, its resilience causes it to enter groove 132, thereby locking shaft 130 within bore 118. The fit of shaft 130 within bore 118 and of flange portion 119 within groove 132 are then such that end piece 129 may be rotated freely with respect to column 114.

Lug 134 cooperates with the cutouts 120, 120 to lock end piece 129 in either of two positions of rotation with respect to column 114: in one position the indicium on end piece 129 is visible from the front of the column, and in the other position the blank face is visible. Locking is achieved by rotating end piece 129 so as to urge lug 134 into one of the cutouts 120. Initially, some resistance is encountered, because lug 134 interferes with the protrusions 122,122. After the lug is "snapped" past a protrusion within a cutout, it is retained within the inner portion by the protrusion.

Figure 10:
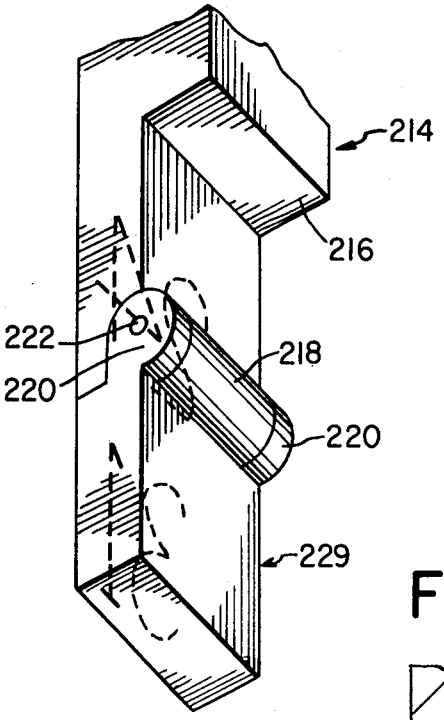
FIG. 10 is a perspective, fragmentary, rear view of the lower portion of a second embodiment of a variable length date column, this embodiment employing a pivoted or hinged endpiece shown in its extended position in FIG. 10.
Figure 11:
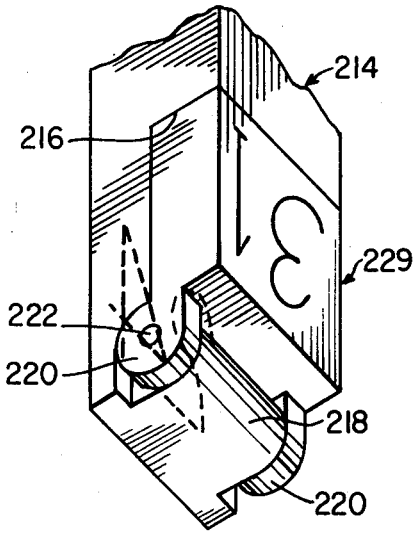
FIG. 11 is a perspective view similar to FIG. 10 showing the endpiece in its retracted position.

Turning now to FIGS. 10 and 11, there is shown an alternate construction for contending with the month length problem. In this construction, the date column 214 is formed with a rabbet 216 at its rear lower end and an end piece 229 is pivotally mounted at the lower end of the date column so as to be retractable by being pivoted rearwardly and upwardly to the position shown in FIG. 11. With end piece 229 in its retracted position, its rear and side surfaces are flush with those of date column 214 so as to give the appearance of a single block. When the end piece 229 pivoted downwardly to its extended position, the face including the indicium (in this case the number 31, is flush with the front face of date column 214. And the month length is thereby extended.

Pivotal mounting of end piece 229 to date column 214 is achieved by means of a hinge joint comprising the barrel-like protrusion 218 at the bottom and rear of the date column and the protruding ears 220, 220. The ears 220, 220 and the protrusion 218 have aligned bores through which a hinge pin 222 is inserted. Preferably, the pin 222 has a slight interference fit within the bores, so that the end piece 229 is held in its retracted position by friction and will not drop accidentally. On either side of the protrusion 218, the bottom of column 214 is provided with a contoured rabbet 224 shaped to receive one of the ears 220 (see FIG. 10), while permitting free rotation of the ears therein.

Figure 12:
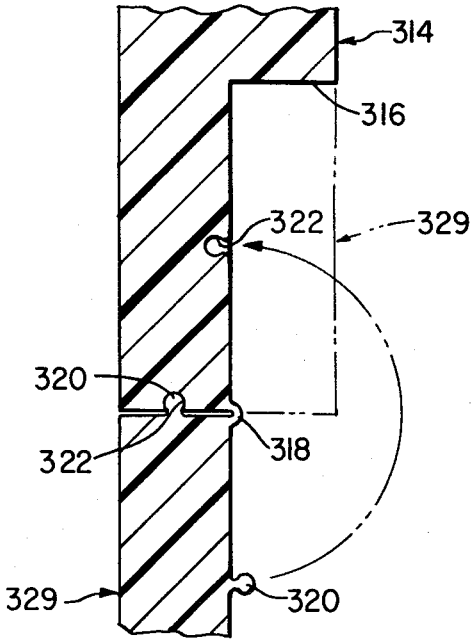
FIG. 12 is a sectional view of an alternate embodiment of the hinged endpiece.

FIG. 12 illustrates an alternate form of the construction illustrated in FIGS. 10 and 11. In this version, a date column 314 is provided with a rearwardly directed rabbet 316 at its lower end, similar to the rabbet 216 on column 214. An end piece 329 is pivotally mounted to column 314 at its lower rear corner by means of an integral or "living" hinge 318 comprising a strip of flexible material joining the date column and end piece together. The end piece 329 is therefore movable from its retracted position (shown in phantom in FIG. 12) to its extended position (shown solid). In each position, the end piece 329 is retained against movement by means of a bulbed protrusion 320 which is engagingly received in a tapered recess or aperture 322. The apertures are tapered in the sense that their openings have a smaller diameter than their interiors. The date column and end piece are preferably made of somewhat resilient material, such as plastic, which assures the flexibility of the hinge member 318, as well as the reduced size openings of the apertures 322, 322. The resilience of the aperture openings permits them to deform when one of the protrusions 320 is pressed into the opening, thereby permitting the protrusion to enter into the aperture and to be retained therein.

If desired, a calendar construction could be fabricated with only one column having a reversible mounting structure 58 secured thereto which would carry the numeral "31" on one of its faces. This would be sufficient for all the months of the year except February, for which the numerals "29" and "30" would always be exposed. However, this deficiency would be compensated by a reduction in complexity and cost of manufacture. If desired, a second column could carry a reversible mounting structure for the numeral "30".

A series of operational steps will now be described. Assuming the month is June, 1976, the calendar is suitably supported, and then the month display members 22 are arranged in receptacle 20 so that indicia **22*a* showing "JUNE" is upwardly oriented and forwardly displayed. Other month display members 22** are placed rearwardly of "JUNE" and thereby stored.

Since the first day of June, 1976 is on a Tuesday, the date column **26*a* showing a "1" is placed at the uppermost point of date column area 30 under the weekday indicia 24 designated "T" (for Tuesday). Consecutively, date columns 26*b*, 26*c*, 26*d*, 26*e* are placed at the uppermost points of date column area 30 under the weekday indicia designated "W", "T", "F", "S", respectively. Date columns 26*f*, 26*g*, are placed under designations "S" and "M" at the beginning of the week, but with single voids left at the top of each of those date columns to denote that no date on those columns occurs during the first calendar week of June, 1976. The arrangement of the two track openings 86, 88 of date columns 26*f*, 26*g*, and the arrangement of tracks 36**, allows this configuration.

It is next determined that June, 1976, has only thirty days, so that the adjustable end piece including the numeral 31 days, so that the adjustable end piece including the numeral 31 is rotated or retracted to its blank display.

The above clearly illustrates a convenient, simple, yet truly permanent calendar structure which may be formed of any one of a number of attractive materials.

While there have been shown and described preferred embodiments of the present invention, it is apparent that numerous alterations, omissions and additions may be made without departing from the spirit thereof as defined in the accompanying claims.

What is claimed is:

1. An improved permanent calendar assembly to precisely display any month of the year and reflect the number of days in the desired month, said assembly having a date column area, a plurality of date columns, and means to detachably secure said colunns to said date column area, the improvement comprising:

at least one reversible mounting structure secured at the lower end of a respective one of said date columns for rotation about an axis extending along said column;

a pair of opposed surfaces on said mounting structure, a rear surface being unnumbered, the other surface defining a front surface having thereon a numberal representing the date of a day of the month; and a lug on one of said mounting structure and said one date column extending toward the other of said mounting structure and said one date column; said other of said mounting structure and said one date column having openings on opposite sides of said axis extending thereinto and through the rear thereof, each opening being dimensioned to receive said lug freely therein, but having a protrusion near the rear of said other of said mounting structure and said one date column positioned to interfere with the movement of said lug into said opening, whereby said mounting structure may be rotated to force said lug through the rear portion of one of said openings so that said lug is retained in said one opening.

2. A calendar assembly according to claim 1, further comprising shaft means projecting from a first of said mounting structure and said one date column towards the second of said mounting structure and said one date column, said shaft defining said axis, the second of said mounting structure and said one date column having a bore dimensioned to have said shaft journaled therein, and means for preventing relative axial movement between said shaft and said bore to rotatably retain said shaft within said bore.

3. A calendar assembly according to claim 2 wherein said movement preventing means comprises a protruding flange on one of said bore and said shaft and a recessed groove on the other thereof positioned and dimensioned to receive said one thereof.

4. An improved permanent calendar assembly to precisely display any month of the year and reflect the number of days in the desired month, said assembly having a date column area, a plurality of date columns, and means to detachably secure said columns to said date column area, the improvements comprising:

at least one mounting structure secured at the lower end of a respective one of said columns for pivotal movement about an axis laterally disposed to the length of said column; and a pair of opposed surfaces on said mounting structure, a rear surface being unnumbered, the other surface defining a front surface having thereon a numeral representing the date of a day of the month.

5. A calendar assembly according to claim 4 further comprising integral flexible means connecting said mounting structure and said one column for providing said pivotal mounting.

6. A calendar assembly according to claim 4 or claim 5 further comprising means for retaining said mounting structure in at least one pivoted position with respect to said one column.

7. A calendar assembly according to claim 6 wherein said retaining means comprises a pivot pin defining said axis and means on said mounting structure and said one column for having said pin journaled therein with a slight intereference fit.

8. A calendar assembly according to claim 6 wherein said rotating means comprises:

a bulbed projection on a surface of one of said mounting structure and said one column; and a recess in the other of said mounting structure and said one date column positioned and dimensioned to receive said projection when said mounting structure is in said one pivoted position, said recess tapering to an opening being smaller than said projection.

9. A calendar assembly according to any one of claims 1–4, the improvement comprising:

means in said date column area for supporting said date columns, said supporting means including an engaging surface, at least a portion of which is oriented so that any line perpendicular to said surface portion and directed away therefrom has no directional component toward the top of said date column area; and an engaging surface on each date column positioned to confront said supporting means engaging surface when the date column is mounted on the calendar, so that when the calendar is tilted forward the supporting means and date column engaging surfaces engage, keeping the date columns from falling away from the date column area yet allowing easy removal therefrom.

10. A calendar assembly according to claim 6, the improvement comprising:

means in said date column area for supporting said date columns, said supporting means including an engaging surface, at least a portion of which is oriented so that any line perpendicular to said surface portion and directed away therefrom has no upward component when the calendar is positioned for normal use; and an engaging surface on each date column positioned to confront said supporting means engaging surface when the date column is mounted on the calendar, so that when the calendar is tilted forward the supporting means and date column engaging surfaces engage, keeping the date columns from falling away from the main body yet allowing easy removal therefrom.

* * * * *